US009417560B2

(12) United States Patent
Lee et al.

(10) Patent No.: US 9,417,560 B2
(45) Date of Patent: Aug. 16, 2016

(54) CARTRIDGE UNIT AND ELECTROPHOTOGRAPHIC IMAGE FORMING APPARATUS INCLUDING THE SAME

(71) Applicant: Samsung Electronics Co., Ltd., Suwon-si, Gyeonggi-do (KR)

(72) Inventors: Sang-hoon Lee, Suwon-si (KR); Seung-gweon Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/550,177

(22) Filed: Nov. 21, 2014

(65) Prior Publication Data

US 2015/0234320 A1 Aug. 20, 2015

(30) Foreign Application Priority Data

Feb. 20, 2014 (KR) ..... 10-2014-0019693

(51) Int. Cl.
*G03G 15/08* (2006.01)

(52) U.S. Cl.
CPC .... *G03G 15/0886* (2013.01); *G03G 2215/0668* (2013.01); *G03G 2215/0692* (2013.01)

(58) Field of Classification Search
CPC ..... G03G 15/0668; G03G 15/0692; G03G 15/0886; G03G 2215/0668; G03G 2215/0692
See application file for complete search history.

(56) References Cited

U.S. PATENT DOCUMENTS 4,849,791 A * 7/1989 Hagihara et al. ..... 399/360
5,128,724 A * 7/1992 Hayashi et al. ..... 399/119
6,763,215 B1 * 7/2004 Jones ..... 399/260
2006/0018685 A1 * 1/2006 Chang ..... 399/237
2007/0248384 A1 * 10/2007 Kawai ..... 399/260
2008/0181673 A1 7/2008 Kim et al.
2009/0129824 A1 * 5/2009 Yoshimoto et al. ..... 399/260
2009/0214269 A1 8/2009 Choi et al.
2010/0054816 A1 3/2010 Yoshikawa et al.
2010/0329747 A1 * 12/2010 Kouda ..... 399/262
2011/0262180 A1 10/2011 Suzuki
2012/0003000 A1 * 1/2012 Nishiyama et al. ..... 399/110
2012/0057905 A1 * 3/2012 Itabashi ..... 399/258

(Continued)

FOREIGN PATENT DOCUMENTS

EP 0 374 920 A2 6/1990
EP 0 374 920 A3 6/1990
EP 2 012 195 A2 1/2009
EP 2 012 195 A3 1/2009
JP 2008-52033 3/2008
JP 2010-54755 3/2010

OTHER PUBLICATIONS

PCT International Search Report dated Feb. 17, 2015 in corresponding International Patent Application No. PCT/KR2014/011159.

(Continued)

*Primary Examiner* — Ryan Walsh
(74) *Attorney, Agent, or Firm* — Staas & Halsey LLP

(57) ABSTRACT

A cartridge unit to discharge toner via a toner outlet and an electrophotographic image forming apparatus are provided. The cartridge unit includes a shutter unit movable between an opening position in which the toner outlet is opened and a closing position in which the toner outlet is closed in a first direction, and a lever unit movable in a second direction across the first direction, and connected to the shutter unit such that the shutter unit moves in the first direction when the lever unit moves in the second direction.

19 Claims, 19 Drawing Sheets

(56) References Cited

U.S. PATENT DOCUMENTS

| | | | | |
|---|---|---|---|---|
| 2012/0106985 | A1 | 5/2012 | Tanaka | |
| 2012/0114390 | A1* | 5/2012 | Ozawa et al. | 399/262 |
| 2013/0170869 | A1* | 7/2013 | Buchanan et al. | 399/258 |
| 2013/0170870 | A1* | 7/2013 | Yoon et al. | 399/258 |
| 2013/0243445 | A1 | 9/2013 | Takahira et al. | |
| 2014/0348547 | A1* | 11/2014 | Tanaka | 399/260 |

OTHER PUBLICATIONS

European Search Report issued Jul. 28, 2015 in corresponding European Patent Application No. 15152004.6.

European First Examination Report issued Aug. 21, 2015 in corresponding European Patent Application No. 15152004.6.

* cited by examiner

CARTRIDGE UNIT AND ELECTROPHOTOGRAPHIC IMAGE FORMING APPARATUS INCLUDING THE SAME

CROSS-REFERENCE TO RELATED APPLICATIONS

This application is related to, and claims the priority benefit of, Korean Patent Application No. 10-2014-0019693, filed on Feb. 20, 2014, in the Korean Intellectual Property Office, the disclosure of which is incorporated herein in its entirety by reference.

BACKGROUND

1. Field

One or more embodiments relate to a cartridge unit that is detachably mounted in an electrophotographic image forming apparatus to supply toner, and an electrophotographic image forming apparatus including the cartridge unit.

2. Description of the Related Art

An image forming apparatus using electrophotography prints an image on a recording medium by supplying toner to an electrostatic latent image formed on a photoreceptor to form a visible toner image on the photoreceptor, transferring the visible toner image to the recording medium, and fusing the transferred visible toner image on the recording medium.

An electrophotographic image forming apparatus includes a development cartridge (or a process cartridge) that develops the visible toner image on the photoreceptor and a toner cartridge that contains toner that is to be supplied to the development cartridge. The toner cartridge may be detachable from the electrophotographic image forming apparatus. When the toner contained in the toner cartridge is completely consumed, the toner cartridge may be replaced with a new toner cartridge.

The toner cartridge may include a toner outlet that discharges the toner and a shutter that opens and closes the toner outlet to prevent the toner from being discharged from the toner outlet during a replacement process.

When the toner cartridge is mounted in a direction parallel to a width direction of the recording medium when mounting the toner cartridge, the shutter may be designed to operate in a direction parallel to the direction in which the toner cartridge is mounted.

However, when the direction in which the toner cartridge is mounted is not parallel to the direction in which the shutter operates, the operating structure of the shutter may be complex. When the toner cartridge is reduced in size, the operating structure of the shutter may become even more complex.

SUMMARY

One or more embodiments include a cartridge unit including a shutter unit movable in a direction across a pressure direction and the electrophotographic image forming apparatus including the cartridge unit.

Additional aspects will be set forth in part in the description which follows and, in part, will be apparent from the description, or may be learned by practice of the presented embodiments.

According to one or more embodiments, a cartridge unit for discharging toner via a toner outlet, the cartridge unit including a shutter unit movable between an opening position in which the toner outlet is opened and a closing position in which the toner outlet is closed, in a first direction, and a lever unit movable in a second direction which crosses the first direction, and connected to the shutter unit such that the shutter unit moves in the first direction when the lever unit moves in the second direction.

When external force is applied to the lever unit, the lever unit may move in the second direction from a reference position that is a position before the external force is applied to the lever unit to a pressure position that is a position after the external force is applied to the lever unit.

When the lever unit moves from the reference position to the pressure position, the shutter unit may move from a closing position to an opening position. Alternatively, when the lever unit moves from the reference position to the pressure position, the shutter unit may move from the opening position to the closing position.

A movement distance from the reference position to the pressure position may be different from a movement distance between the closing position and the opening position.

A movement distance from the reference position to the pressure position may be the same as a movement distance between the closing position and the opening position.

One of the shutter unit and the lever unit may include a movement pin, and the other may include a movement guide formed extending in a direction which crosses the first direction such that the movement guide guides movement of the movement pin.

The cartridge unit may include a bendable member bendable from the first direction toward the second direction between the shutter unit and the lever unit.

The shutter unit, the bendable member, and the lever unit may be integrally formed.

The cartridge unit may further include a rotation member contacting the shutter unit and the lever unit and rotatable.

The cartridge unit may further include a first plate which guides a movement of the shutter unit in the first direction; and a second plate which guides a movement of the lever unit in the second direction.

The second direction may be perpendicular to the first direction.

The second direction may cross a plane on which the toner outlet is formed.

According to one or more embodiments, an electrophotographic image forming apparatus includes a body including an opening and a cover which opens and closes the opening, and a cartridge unit discharging toner via a toner outlet and detachably mounted in the body via the opening, wherein the cartridge unit includes a shutter unit movable between an opening position in which the toner outlet is opened and a closing position in which the toner outlet is closed, in a first direction, and a lever unit movable in a second direction which crosses the first direction, and connected to the shutter unit such that the shutter unit moves in the first direction when the lever unit moves in the second direction.

When external force is applied to the lever unit, the lever unit may move in the second direction from a reference position that is a position before the external force is applied to the lever unit to a pressure position that is a position after the external force is applied to the lever unit.

When the lever unit moves from the reference position to the pressure position, the shutter unit may move from the closing position to the opening position.

A movement distance from the reference position to the pressure position may be different from a movement distance between the closing position and the opening position.

The second direction may cross a plane on which the toner outlet is formed.

The cover may include a pressure rod which applies pressure to a lever unit and moves a shutter unit from a closing position to an opening position when closing the opening.

The body may include an interference member which applies pressure to a lever unit and moves a shutter unit from a closing position to an opening position when mounting the cartridge unit.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
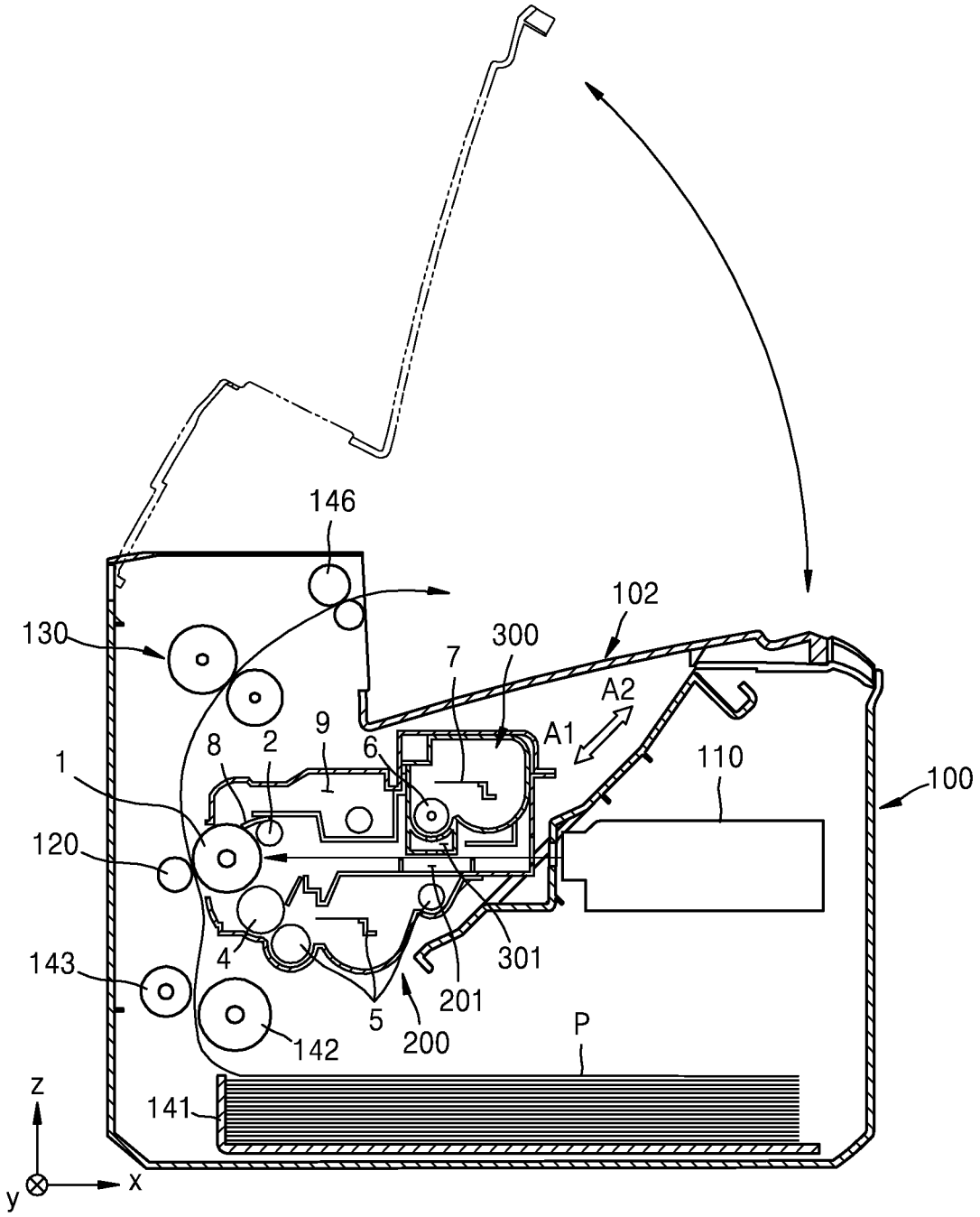
FIG. 1 is a schematic view of an electrophotographic image forming apparatus according to an embodiment.

Reference will now be made in detail to embodiments, examples of which are illustrated in the accompanying drawings, wherein like reference numerals refer to like elements throughout. Exemplary embodiments may have different forms and should not be construed as being limited to the descriptions set forth herein. Accordingly, the embodiments are described below, by referring to the figures, to explain aspects of the description. Expressions such as "at least one of," when preceding a list of elements, modify the entire list of elements and do not modify the individual elements of the list.

Electrophotographic Image Forming Apparatus

Figure 2:
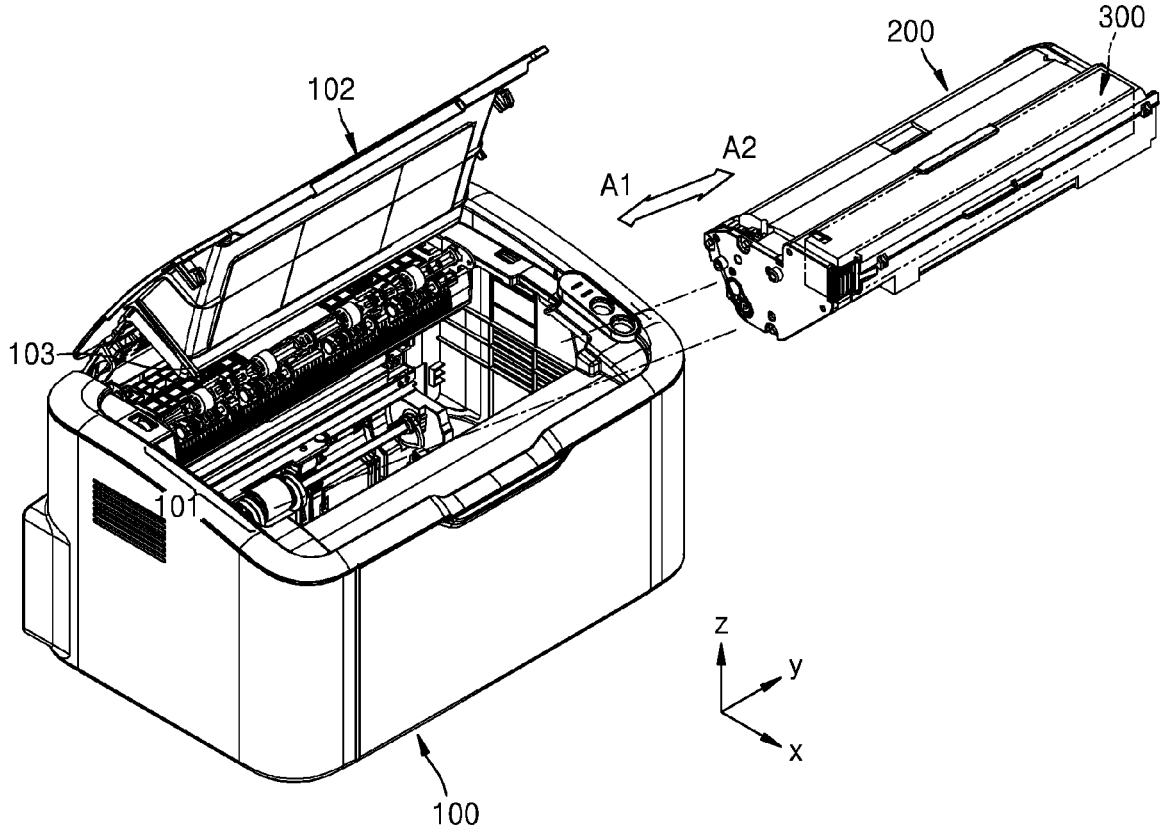
FIG. 2 is a schematic perspective view of an electrophotographic image forming apparatus, wherein a development cartridge and a toner cartridge are removed from a body, according to an embodiment.

FIG. 1 is a schematic view of an electrophotographic image forming apparatus according to an embodiment. FIG. 2 is a schematic perspective view of the electrophotographic image forming apparatus of FIG. 1, wherein a development cartridge 200 and a toner cartridge 300 are removed from a body 100, according to an embodiment.

Referring to FIGS. 1 and 2, the electrophotographic image forming apparatus includes the body 100, the development cartridge 200, and the toner cartridge 300. The body 100 includes an opening 101 providing a passage for mounting and removing the development cartridge 200 and the toner cartridge 300 in respective directions A1 and A2. A cover, for example, an upper cover 102 closes or opens the opening 101. The body 100 includes an exposure unit 110, a transfer roller 120, and a fusing unit 130. The body 100 includes a recording medium transfer structure to load and transfer a recording medium P on which an image is to be formed.

The development cartridge 200 includes a photoconductive drum 1. The photoconductive drum 1 is an example of a photoreceptor, wherein an electrostatic latent image is formed on a surface thereof, and may include a conductive metal pipe and a photosensitive layer around the conductive metal pipe. A charging roller 2 is an example of a charger for charging the photoconductive drum 1 to have a uniform surface potential. A charging brush or a corona charger may be used instead of the charging roller 2. A cleaning blade 8 is an example of a cleaning unit for removing toner and foreign materials on a surface of the photoconductive drum 1 after a transfer process described later. A cleaning apparatus having another shape, such as a rotating brush, may be used instead of the cleaning blade 8. The toner and foreign materials removed by the cleaning blade 8 may be collected in a waste toner container 9.

A development roller 4 may be used to supply the toner in the toner cartridge 300 to the photoconductive drum 1. A development bias voltage may be applied to the development roller 4. Transport members 5 transport the toner supplied from the toner cartridge 300 to the development roller 4.

The toner cartridge 300 supplies the toner contained therein to the development cartridge 200. The toner cartridge 300 includes a toner outlet 301. The development cartridge 200 includes a toner inlet 201. The development cartridge 200 and the toner cartridge 300 may be mounted in the body 100 to which the toner outlet 301 and the toner inlet 201 are connected. The upper cover 102 may be used to open and close the opening 101.

The toner cartridge 300 includes a transporting member 6 and an agitator 7. The transport member 6 transports the toner to the toner outlet 301. The agitator 7 stirs the toner and moves the toner toward the transport member 6. A one-component contact development method may be used in an exemplary embodiment, however, an exemplary embodiment is not limited thereto. A development method using plural components, e.g., a two-component development method may be employed.

The exposure unit 110 forms the electrostatic latent image on the photoconductive drum 1 by irradiating light modulated according to image information onto the photoconductive drum 1. The exposure unit 110 may be a laser scanning unit (LSU) using a laser diode as a light source, or a light-emitting diode (LED) exposure unit using an LED as a light source.

The transfer roller 120 is an example of a transfer unit for transferring a toner image from the photoconductive drum 1 to the recording medium P. A transfer bias voltage for transferring the toner image to the recording medium P is applied to the transfer roller 120. A transfer belt, a corona transfer unit or a transfer unit using a pin scorotron method may be used instead of the transfer roller 120.

The recording media P may be picked up, e.g., one-by-one from a loading tray 141 by a pickup roller 142, and transferred to a region where the photoconductive drum 1 and the transfer roller 120 may face each other by a feed roller 143.

The fusing unit 130 applies heat and pressure to an image transferred to the recording medium P so as to fuse the image onto the recording medium P. The recording medium P that passed through the fusing unit 130 may be discharged outside the body 100 by a discharge roller 146.

According to an exemplary embodiment, the exposure unit 110 irradiates the light modulated according to the image information onto the photoconductive drum 1 to develop the electrostatic latent image. The development roller 4 supplies the toner to the electrostatic latent image to form the visible toner image on the surface of the photoconductive drum 1. The recording medium loaded in the loading tray 141 may be transferred to the region where the photoconductive drum 1 and the transfer roller 120 face each other by the pickup roller 142 and the feed roller 143, and the toner image may be transferred to the recording medium P from the photoconductive drum 1 according to the transfer bias voltage applied to the transfer roller 120. After the recording medium P passes through the fusing unit 130, the toner image may be used onto the recording medium P according to heat and pressure. After the fusing, the recording medium P may be discharged by the discharge roller 146.

The development cartridge 200 and the toner cartridge 300 are consumable products that may be replaced, for example, after their lifespan is expired. Accordingly, the development cartridge 200 and the toner cartridge 300 may be detachably installed in the body 100. For example, as illustrated in FIG. 2, the development cartridge 200 and the toner cartridge 300 may be mounted and removed, for example, in the respective directions A1 and A2, which are directions that cross a length direction (y axis) of the transfer roller 120 (see, for example, FIG. 1) formed in the body 100. The development cartridge 200 and the toner cartridge 300 may be mounted in, and removed from, the body 100 via the opening 101 formed in the body 100. The opening 101 may be opened and closed by the upper cover 102.

Figure 3A:
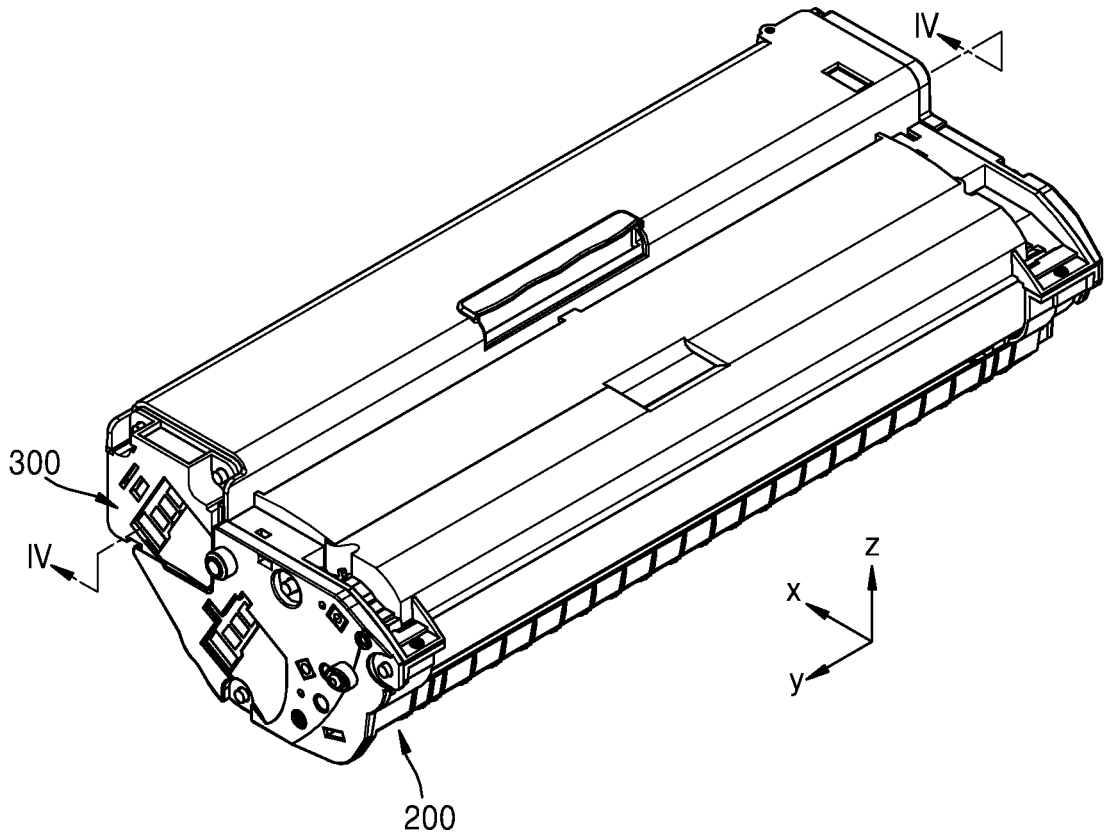
FIG. 3A is a perspective view of an exemplary development cartridge and toner cartridge.
Figure 3B:
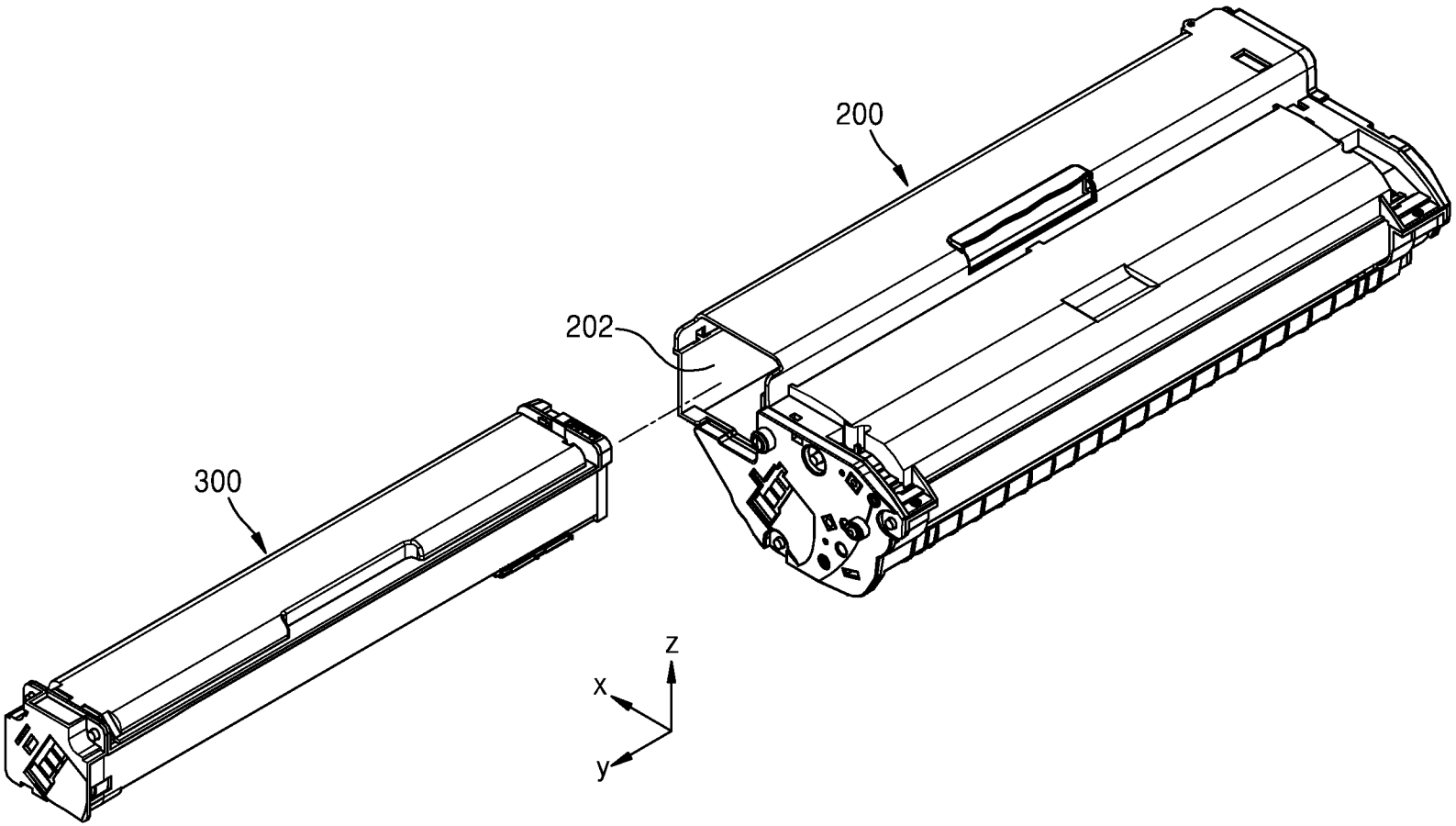
FIG. 3B is a perspective view of an exemplary toner cartridge separated from a toner cartridge.

Lifespan of the development cartridge 200 and the toner cartridge 300 may be different, and thus the development cartridge 200 and the toner cartridge 300 may be individually replaced. FIG. 3A is an exemplary perspective view of the development cartridge 200 and the toner cartridge 300 of FIG. 2. FIG. 3B is a perspective view of the toner cartridge 300 separated from the development cartridge 200 of FIG. 3A. Referring to FIGS. 3A and 3B, the development cartridge 200 includes an insertion part 202 into which the toner cartridge 300 may be inserted. The insertion part 202 may be formed extending in a length direction (y axis) of the development cartridge 200. A cross-sectional shape of the insertion part 202 in a direction perpendicular to the length direction (y axis) may correspond to a cross-sectional shape of the toner cartridge 300 in the direction perpendicular to the length direction (y axis). The toner cartridge 300 may be inserted into, or removed from, the insertion part 202 such that the toner cartridge 300 may be mounted in or removed from the development cartridge 200 in a direction parallel to the length direction (y axis) of the development cartridge 200. When the toner cartridge 300 is mounted in the development cartridge 200, the development cartridge 200 is mounted in, or removed from, the body 100 as illustrated in FIG. 2, and thus the toner cartridge 300 may be mounted in or removed from the body 100.

The toner cartridge 300 may be mounted in, or removed from, the body 100 in the same direction A1 or A2 as the direction in which the development cartridge 200 is mounted in, or removed from, the body 100, and may be mounted in, or removed from, the development cartridge 200 in a different direction (y axis) from the direction A1 or A2 in which the development cartridge 200 is mounted in or removed from the body 100.

Figure 4:
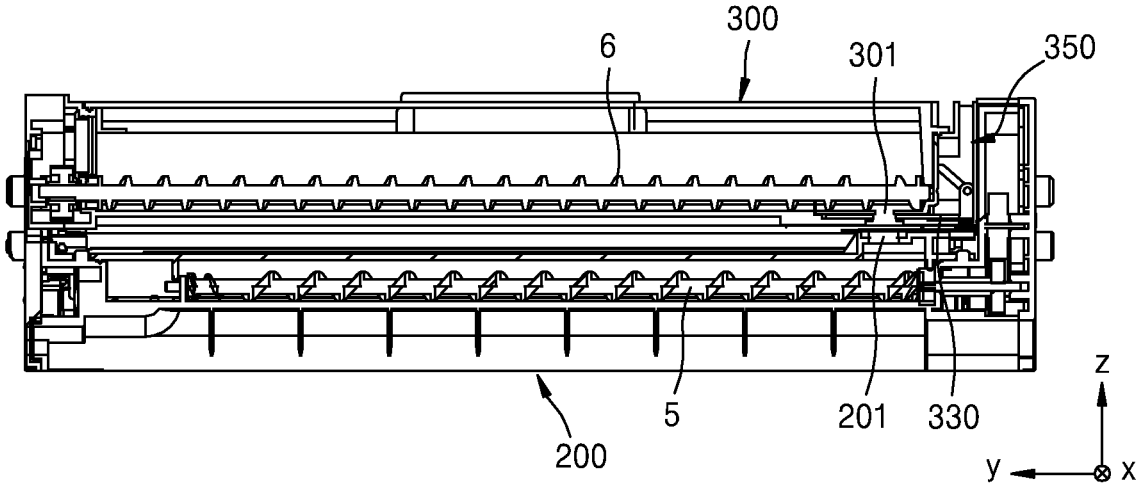
FIG. 4 is a cross-sectional view of a development cartridge and the toner cartridge of FIG. 3A along line IV-IV.

FIG. 4 is a cross-sectional view of the development cartridge 200 and the toner cartridge 300 of FIG. 3A taken along line IV-IV. Referring to FIG. 4, the toner cartridge 300 may be mounted in the development cartridge 200 so that the toner inlet 201 and the toner outlet 301 are positioned to correspond to each other. A shutter unit 330 may be movably disposed in the toner outlet 301. Opening and closing of the toner outlet 301 may be determined by the shutter unit 330. For example, the shutter unit 330 may be movable in a direction parallel to the length direction (y axis) of the development cartridge 200 between an opening position in which the toner outlet 301 is opened and a closing position in which the toner outlet 301 is closed.

A structure for operating the shutter unit 330 may restrict movement of the shutter unit 330 by a predetermined region of the development cartridge 200 such that the shutter unit 330 moves relative to the toner outlet 301 when mounting the toner cartridge 300 in the development cartridge 200. However, such a structure may restrict a degree of design freedom such that the movement of the shutter unit 330 may be restricted from moving in a direction parallel to a direction in which the toner cartridge 300 is mounted. Such a structure may make it difficult to move the shutter unit 330 by a sufficient movement distance upon the toner cartridge 300 being small in size.

The electrophotographic image forming apparatus of an exemplary embodiment has a shutter unit 330 that is simple in structure and flexible in design. As an example, the electrophotographic image forming apparatus of an exemplary embodiment has a structure in which a cartridge unit that is detachably mounted in the body 100, for example, the shutter unit 330 of the toner cartridge 300, is movable in a direction that crosses a direction in which an external force is applied to the cartridge unit. As an example of the cartridge unit, an exemplary toner cartridge 300 is described below. However, the cartridge unit is not limited to the toner cartridge 300 and may be the development cartridge 200 or another element that may be detachably mounted in the body 100.

Toner Cartridge 300

Figure 5A:
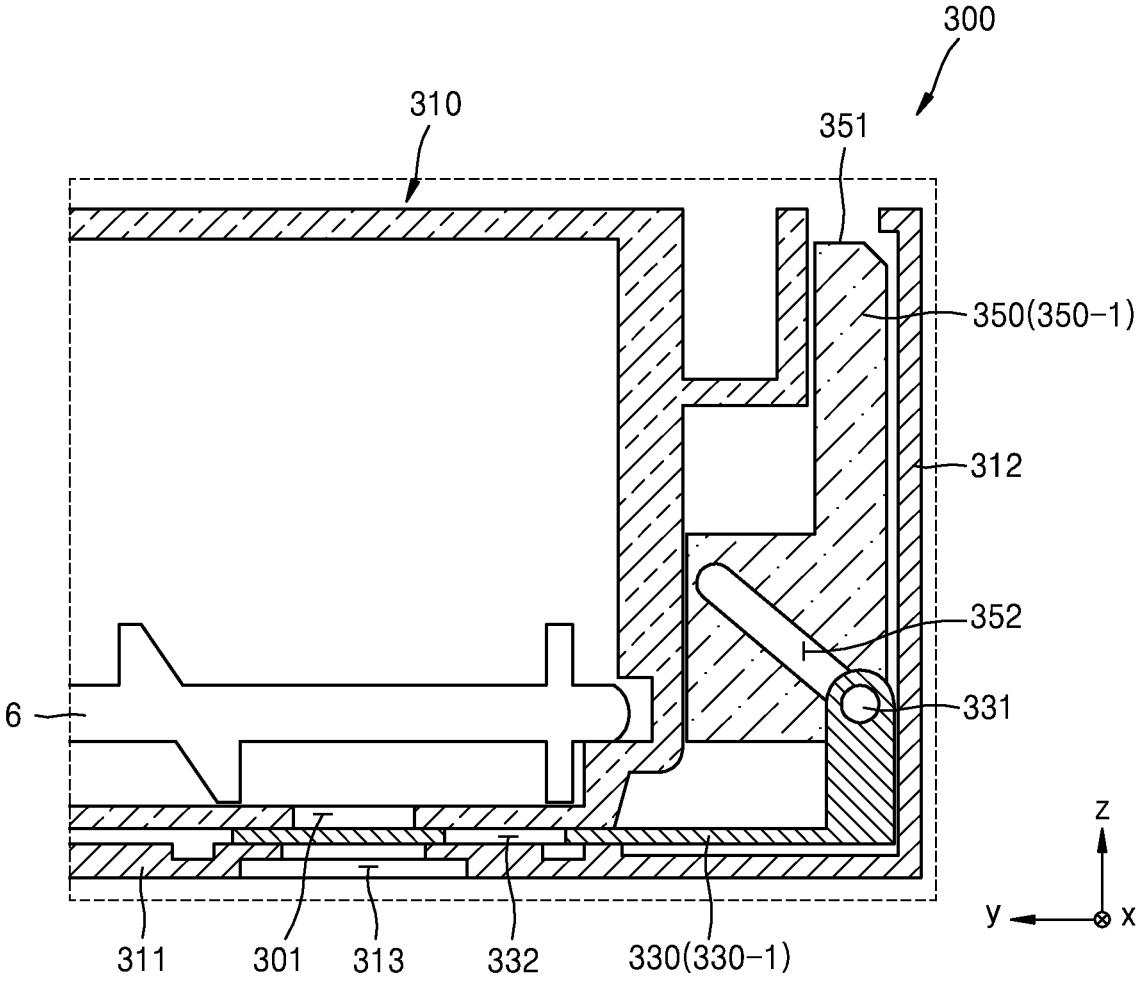
FIG. 5A is a cross-sectional view of a part of the toner cartridge of FIG. 4.
Figure 5B:
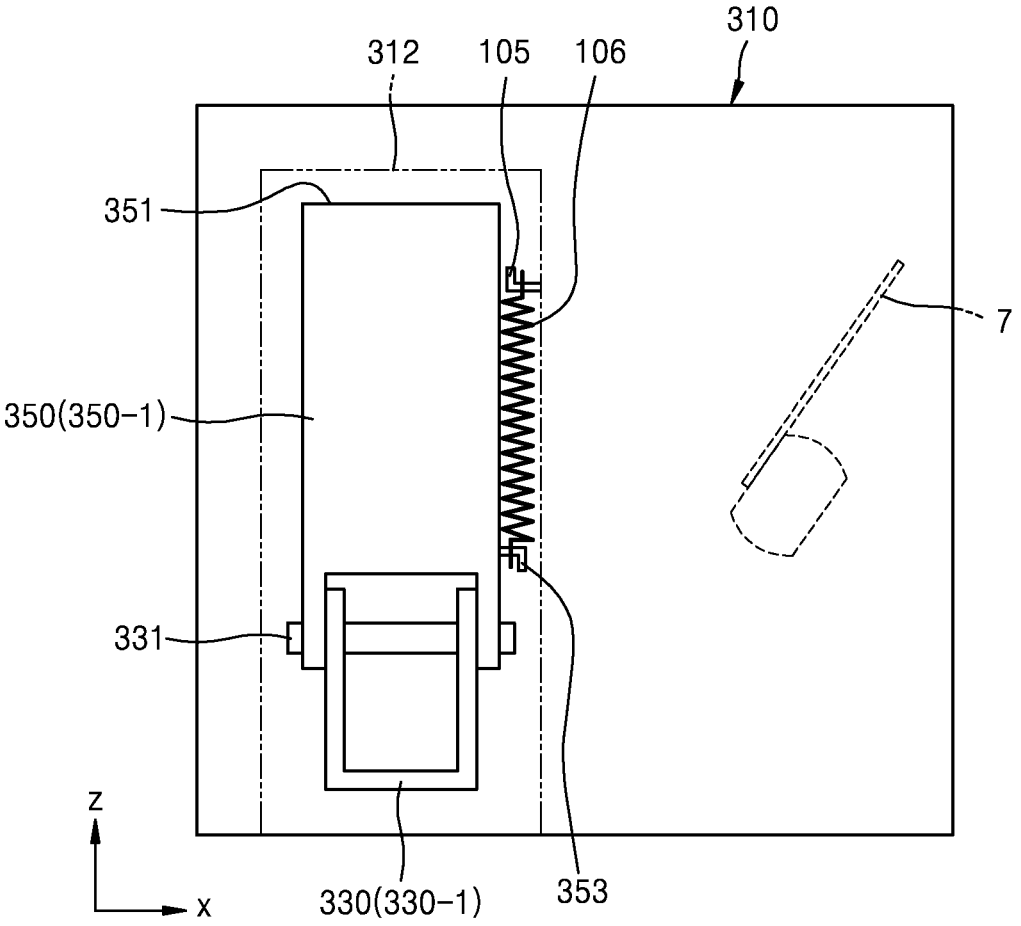
FIG. 5B is a right lateral view of FIG. 5A.

FIG. 5A is a cross-sectional view of a part of the toner cartridge 300 of FIG. 4, and FIG. 5B is a right lateral view of FIG. 5A. In FIG. 5B, a second plate 312 is illustrated in a two-dot chain line for convenience of illustration, so as to clearly illustrate the shutter unit 330 and a lever unit 350.

Referring to FIG. 5A, the toner cartridge 300 includes a container unit 310 that contains toner therein and in which the toner outlet 301 may be formed, the shutter unit 330 that opens and closes the toner outlet 301, and the lever unit 350 that is connected to the shutter unit 330 and moves the shutter unit 330.

The container unit 310 includes a space for containing the toner. The transport member 6 for transporting the toner is installed in the space. The toner transported by the transport member 6 may be discharged via the toner outlet 301.

The shutter unit 330 may be installed in the toner outlet 301 and is movable in a length direction (hereinafter referred to as a "first direction (y axis)") of the toner cartridge 300. An opening 332 corresponding to the toner outlet 301 may be formed in the shutter unit 330. When the shutter unit 330 rectilinearly moves left in the first direction (y axis) so that the opening 332 overlaps with the toner outlet 301, the toner is discharged to the outside via the toner outlet 301. A position of the shutter unit 330 may define an opening position 330-2 (see, for example, FIG. 6B). When the shutter unit 330 rectilinearly moves right in the first direction (y axis) so that the opening 332 does not overlap with the toner outlet 301, discharge of the toner to the outside is prevented. A position of the shutter unit 330 may define a closing position 330-1.

A first plate 311 may be disposed in a lower portion of the shutter unit 330. The first plate 311 guides movement of the shutter unit 330 in the first direction (y axis) and restricts movement of the shutter unit 330 in a second direction (z axis). An outlet 313 may be formed at a position on the first plate 311 corresponding to the toner outlet 301. When the shutter unit 330 is in the opening position 330-2, the toner outlet 301, the opening 332, and the outlet 313 overlap with each other, and thus the toner contained in the toner cartridge 300 may be discharged to the outside. The discharged toner may be injected into the toner inlet 201 (see, for example, FIG. 4) of the development cartridge 200 of FIG. 1.

The lever unit 350 may be connected to the shutter unit 330 and transfers external forces applied in a direction that crosses the first direction (y axis) to the shutter unit 330.

As an example of a connection structure of the lever unit 350 and the shutter unit 330, one of the lever unit 350 and the shutter unit 330 includes a movement pin 331, and the other includes a movement guide 352 that guides movement of the movement pin 331. Referring to FIG. 5A, the movement pin 331 is provided in the shutter unit 330, and the movement guide 352 is provided in the lever unit 350. The movement pin 331 may be formed separately from the shutter unit 330 but is not limited thereto. The movement pin 331 may be integrally formed with the shutter unit 330.

The movement guide 352 may be formed extending in the direction that crosses the first direction (y axis). For example, the movement guide 352 may be formed by extending in a direction that is at an acute angle to the first direction (y axis). The movement guide 352 may be formed by extending in a direction that crosses the second direction (z axis). For example, the movement guide 352 may be formed by extending in a direction that is at an acute angle to the second direction (z axis). The movement pin 331 may be inserted into the movement guide 352. In accordance with a movement of the lever unit 350 in which the movement guide 352 is provided, the movement pin 331 inserted into the movement guide 352 moves in the first direction (y axis). The shutter unit 330 moves in the first direction (y axis) by the movement of the movement pin 331 in the first direction (y axis).

The lever unit 350 may be movable to the second direction (z axis) that crosses the first direction (y axis). For example, the second direction (z axis) may be perpendicular to the first direction (y axis). The second direction (z axis) may be a direction that crosses a plane (xy plane) on which the toner outlet 301 is formed.

The second plate 312 that may be formed in parallel to the second direction (z axis) may be disposed in a side portion of the level unit 350. The second plate 312 guides movement of the level unit 350 in the second direction (z axis), and restricts movement of the lever unit 350 in the first direction (y axis).

An end portion 351 of the lever unit 350 may be disposed such that the end portion 351 does not protrude outside of the toner cartridge 300, which may prevent the lever unit 350 from being unintentionally pressed when mounting the toner cartridge 300 in the development cartridge 200 and when mounting the development cartridge 200, in which the toner cartridge 300 is mounted, in the body 100.

Referring to FIG. 5B, the lever unit 350 may be connected to the container unit 310 by an elastic member 106. One end of the elastic member 106 may be connected to a protrusion 353 of the lever unit 350, and another end thereof is connected to a protrusion 105 of the container unit 310. If the external force applied to the lever unit 350 is removed, the lever unit 350 may be restored to a reference position 350-1 by the elastic member 106. A spring may be used as an example of the elastic member 106, but the elastic member 106 is not limited thereto.

Operating states of Shutter Unit 330 and Lever Unit 350

Figure 6A:
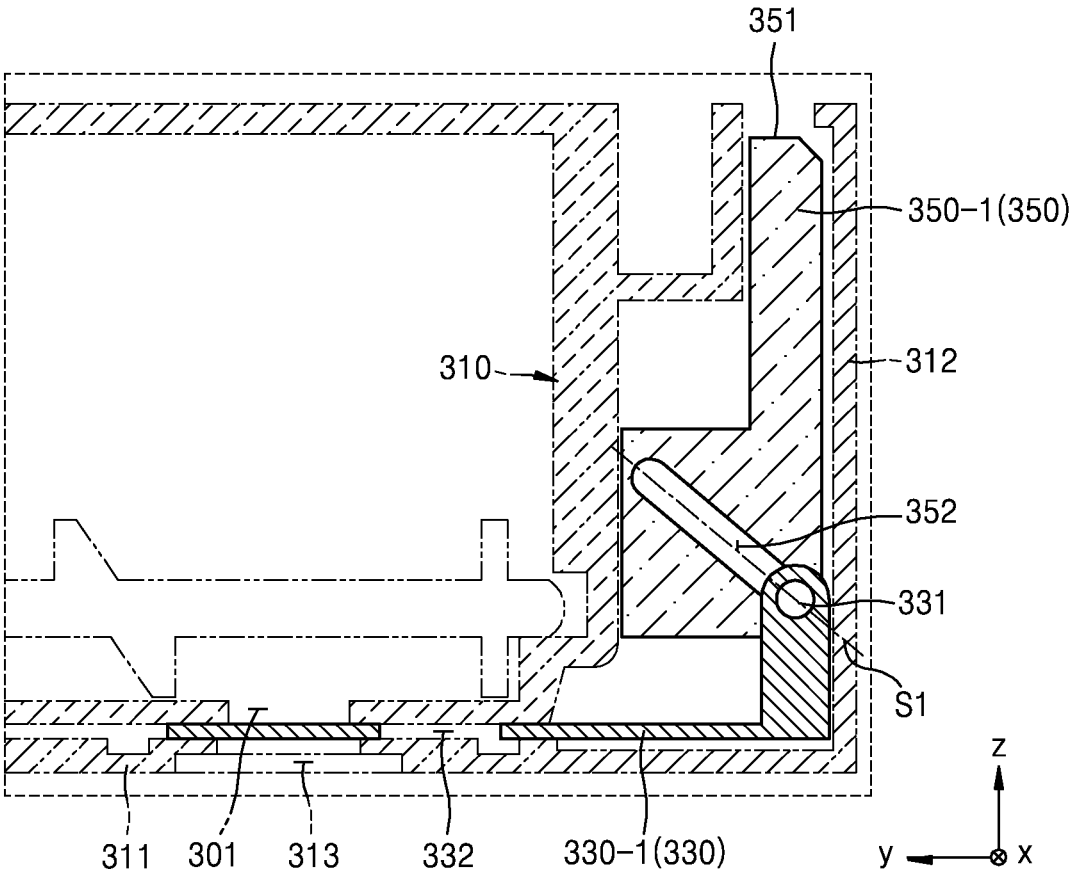
FIGS. 6A and 6B illustrate exemplary operating states of a lever unit and a shutter unit when an external force is applied to the lever unit of the toner cartridge of FIG. 5A.
Figure 6B:
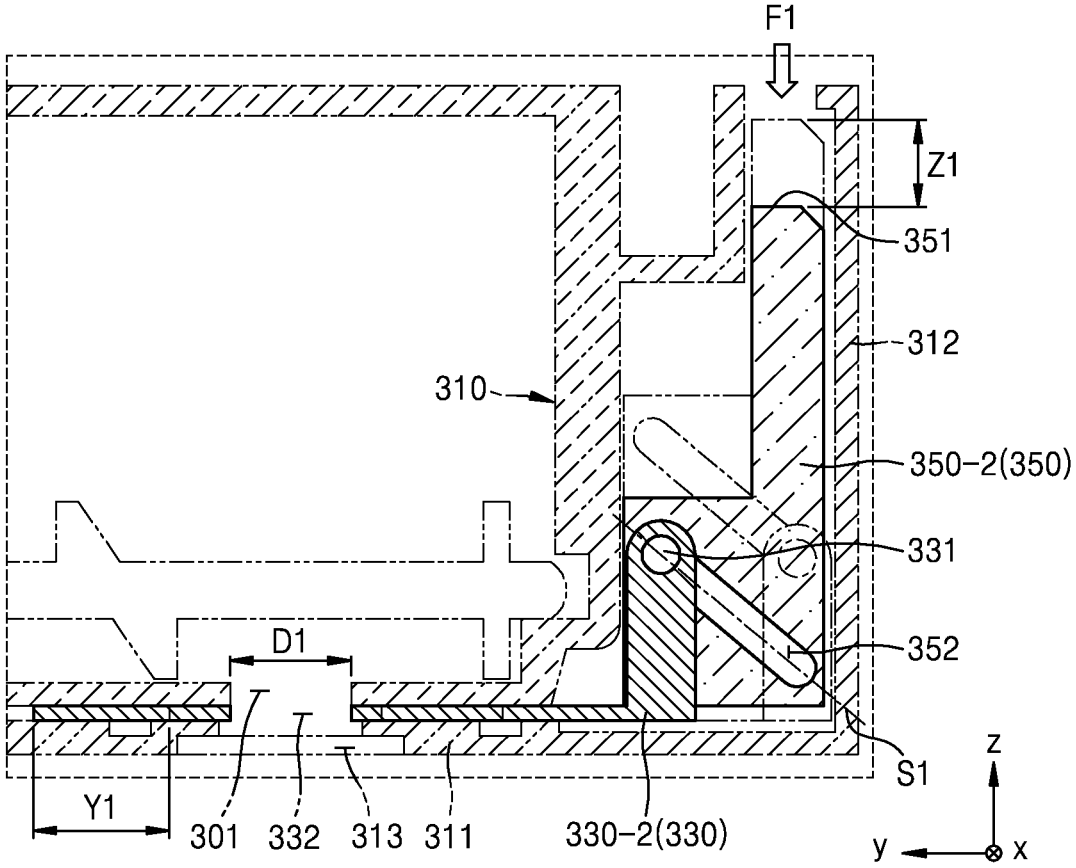

FIGS. 6A and 6B conceptually illustrate operating states of the lever unit 350 and the shutter unit 330 when an external force F1 is applied to the lever unit 350 of the toner cartridge 300 of FIG. 5A. FIG. 6A illustrates the operating state before the external force F1 is applied to the lever unit 350. FIG. 6B illustrates the operating state after the external force F1 is applied to the lever unit 350. For convenience of illustration, elements other than the lever unit 350 and the shutter unit 330 are illustrated with broken lines.

Referring to FIG. 6A, before the external force F1 is applied to the lever unit 350, the lever unit 350 may be disposed in the reference position 350-1, and the shutter unit 330 may be disposed in the closing position 330-1. The movement pin 331 of the shutter unit 330 may be inserted into the movement guide 352 of the lever unit 350.

Referring to FIG. 6B, if the external force F1 is applied to the end portion 351 of the lever unit 350, pressure is applied to the lever unit 350, the lever unit 350 moves downward by a predetermined distance Z1 in the second direction (z axis), and is disposed in a pressure position 350-2. That is, the lever unit 350 moves from the reference position 350-1 to the pressure position 350-2 in the second direction (z axis) due to the external force F1. When the lever unit 350 moves from the reference position 350-1 to the pressure position 350-2, the movement pin 331 inserted into the movement guide 352 moves in a shape of the movement guide 352. The movement of the shutter unit 330 in the second direction (z axis) may be restricted by the first plate 311, and thus the movement pin 331, which is formed in the shutter unit 330, does not move in the second direction (z axis) but rectilinearly moves in the first direction (y axis). The shutter unit 330 in which the movement pin 331 is formed moves left in the first direction (y axis) by a predetermined distance Y1. Accordingly, the opening 332 of the shutter unit 330 overlaps with the toner outlet 301 such that toner contained in the container unit 310 is discharged to the outside. The movement distance Y1 of the shutter unit 330 may be the same as, or greater than, a width D1 of the toner outlet 301 in the first direction (y axis).

The movement distance Y1 of the shutter unit 330 may be the same as the movement distance Z1 of the lever unit 350. However, the movement distance Y1 of the shutter unit 330 and the movement distance Z1 of the lever unit 350 may be different from each other. A direction in which the movement guide 352 is formed by extending may be changed. A reference numeral S1 denotes a center line of the movement guide 352.

Figure 7:
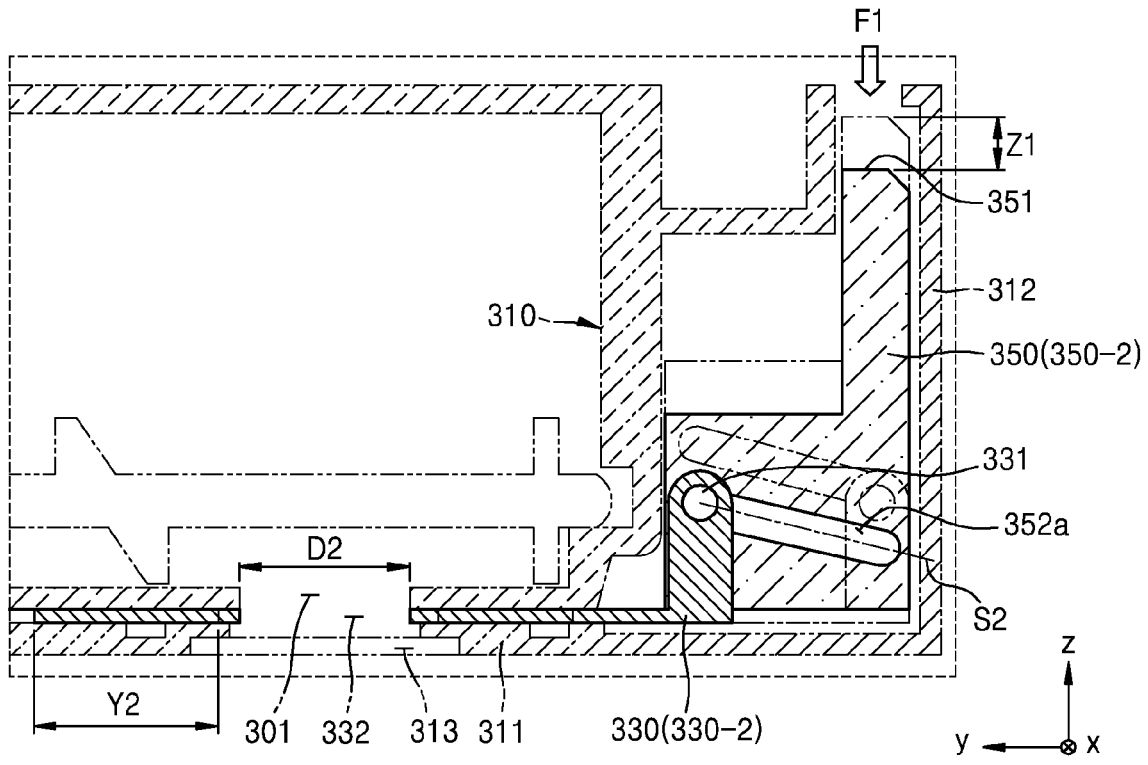
FIG. 7 illustrates an example of changing a direction in which a movement guide of the toner cartridge of FIG. 5A is formed and extends.

FIG. 7 illustrates an example of changing a direction in which a movement guide 352*a* of the toner cartridge 300 of FIG. 5A is formed by extending. Referring to FIG. 7, an angle between a center line S2 of the movement guide 352*a* and the first direction (y axis) may be smaller than 45 degrees, which is half of the angle formed between the first direction (y axis) and the second direction (z axis). When the lever unit 350 moves in the second direction (z axis) by the predetermined distance Z1, the movement pin 331 inserted into the movement guide 352 and the shutter unit 330 in which the movement pin 331 is formed may move in the first direction (y axis) by a distance Y2 different from the predetermined distance Y1. The distance Y2 may be greater than the distance Y1. Thus, although the lever unit 350 moves by the same distance, a movement distance of the shutter unit 330 may differ according to the direction (or an angle) in which the movement guide 352*a* is formed by extending. As illustrated in FIG. 7, the movement distance of the shutter unit 330 in the first direction (y axis) increases, and thus a width D2 of the toner outlet 301 may increase in the first direction (y axis). For example, the width D2 of the toner outlet 301 in the first direction (y axis) may be in the range of about 10 mm to about 40 mm.

According to an exemplary embodiment, when the lever unit 350 is disposed in the reference position 350-1, the shutter unit 330 is disposed in the closing position 330-1, and, when the lever unit 350 is disposed in the pressure position 350-2, the shutter unit 330 is disposed in the opening position 330-2. However, a position relation between the shutter unit 330 and the lever unit 350 is not limited thereto and may be changed as necessary. For example, when the lever unit 350 is disposed in the reference position 350-1, the shutter unit 330 is disposed in the opening position 330-2, and, when the lever unit 350 is disposed in the pressure position 350-2, the shutter unit 330 may be disposed in the closing position 330-1.

Figure 8:
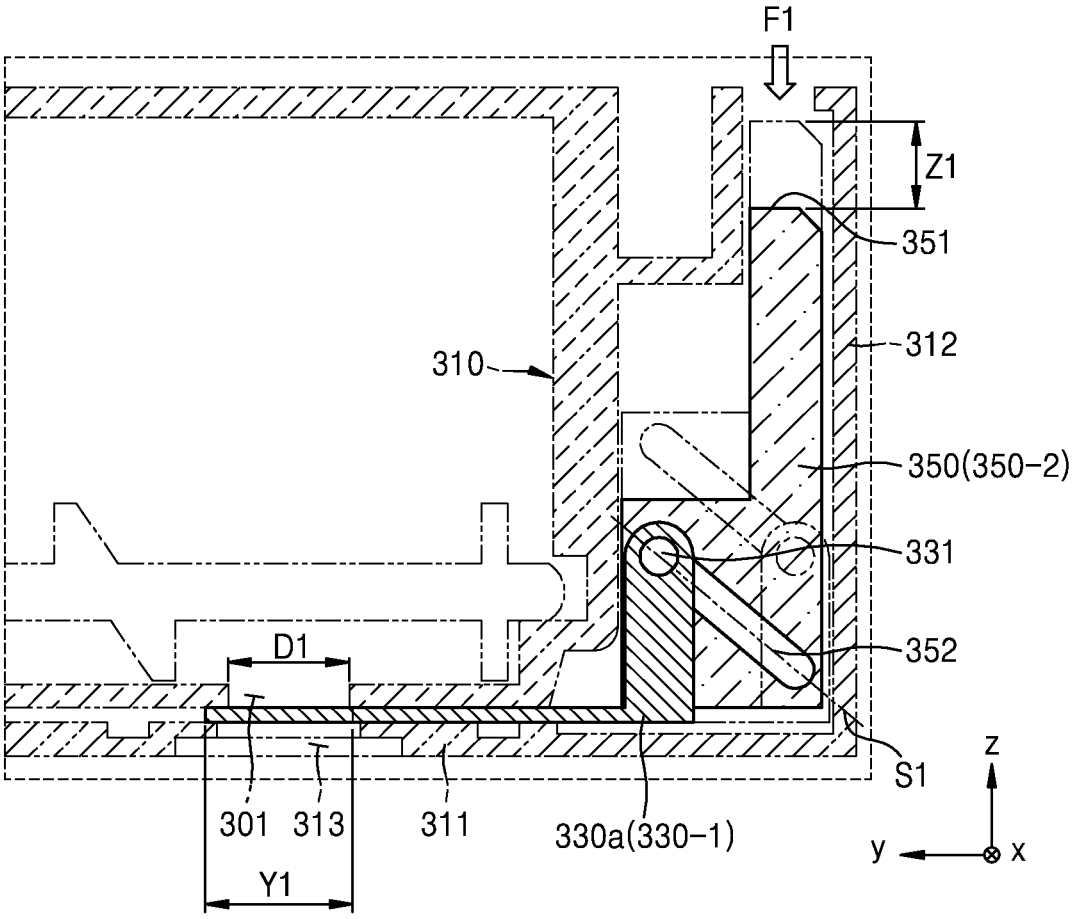
FIG. 8 schematically illustrates an exemplary toner cartridge of FIG. 4.

FIG. 8 schematically illustrates another example of the toner cartridge 300 of FIG. 4. Referring to FIG. 8, the toner cartridge 300 includes the container unit 310, a shutter unit 330*a*, and the lever unit 350. The elements other than the shutter unit 330*a* may be the same as described with reference to FIG. 6B, and thus descriptions thereof are not repeated here. The opening 332 is not formed in the shutter unit 330*a*. When the external force F1 is applied to the lever unit 350, the lever unit 350 moves in the second direction (z axis) by the predetermined distance Z1 to the pressure position 350-2 as illustrated in FIG. 8. The movement pin 331 moves in the first direction (y axis) by the movement guide 352 and thus the shutter unit 330*a* is disposed in the closing position 330-1 such that the toner outlet 301 is blocked. If the external force F1 applied to the lever unit 350 is removed, the lever unit 350 rises and moves to the reference position 350-1, and the shutter unit 330*a* moves right and is disposed in the opening position 330-2.

Function of External Force Applied to Lever Unit 350

External force may be applied to the lever unit 350 in a direction that is not parallel to the first direction (y axis). As an example, pressure may be applied to the end portion 351 of the lever unit 350 by the upper cover 102.

Figure 9A:
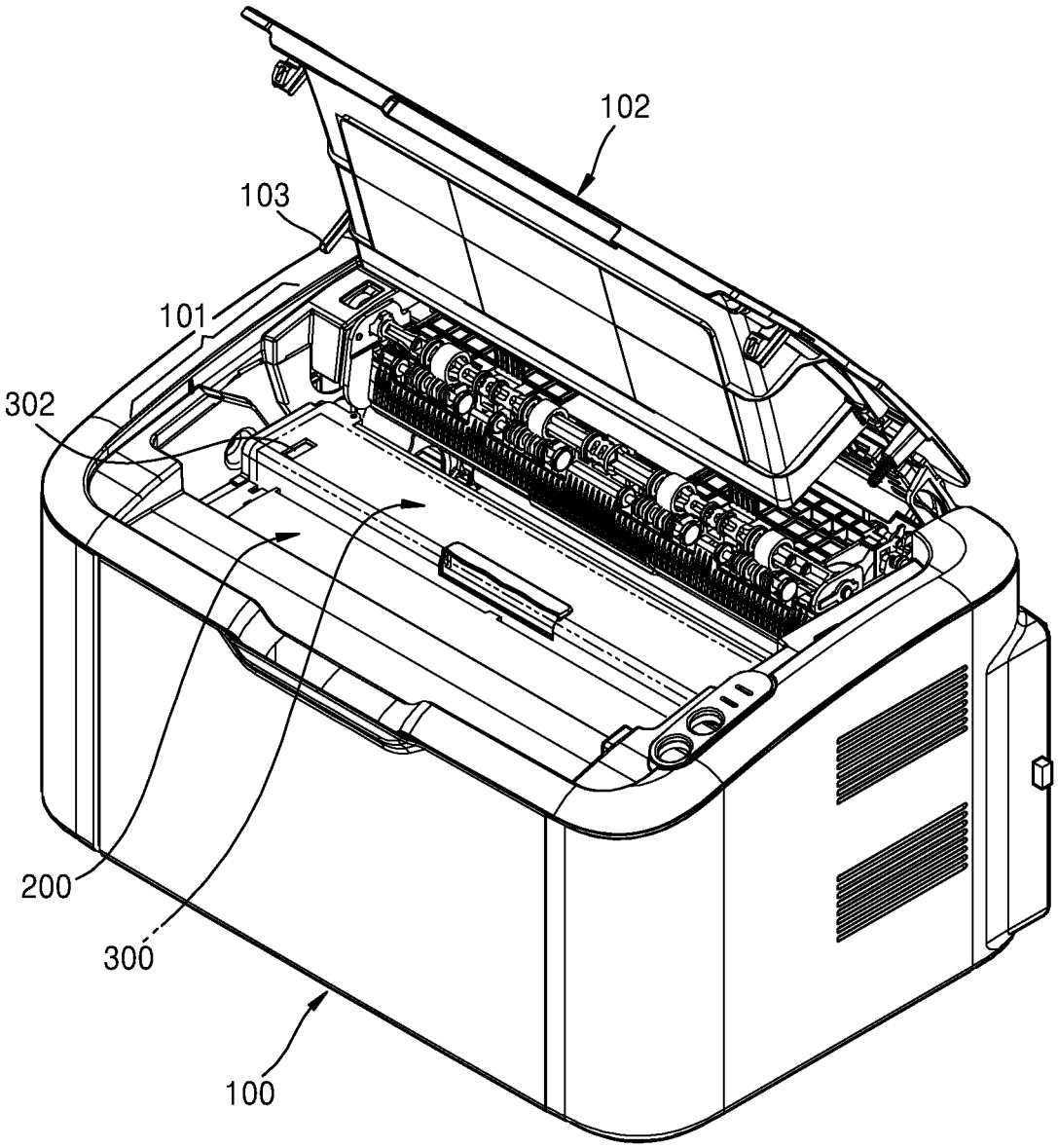
FIG. 9A is a perspective view of an electrophotographic image forming apparatus of FIG. 2, and FIG. 9B schematically illustrates an exemplary movement of a pressure rod according to a closing operation of an upper cover.
Figure 9B:
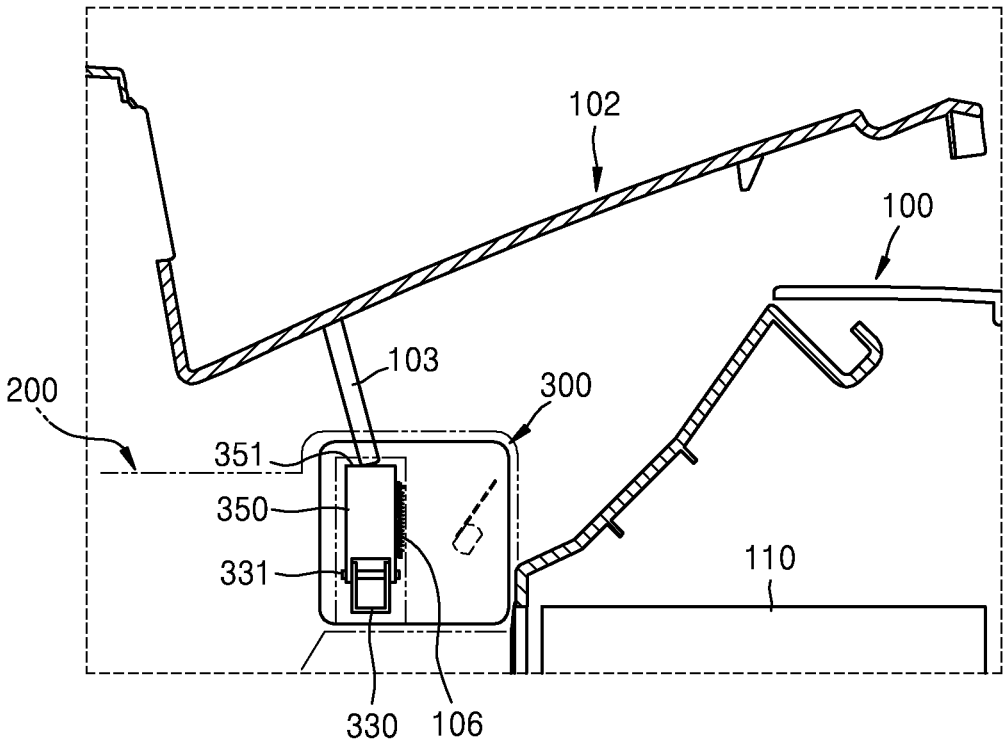

FIG. 9A is a perspective view of the electrophotographic image forming apparatus of FIG. 2 illustrated from a different angle. FIG. 9B schematically illustrates a movement of a pressure rod 103 when the upper cover 102 is closed.

Referring to FIGS. 9A and 9B, no external force is applied to the end portion 351 of the lever unit 350 until the development cartridge 200, in which the toner cartridge 300 is mounted, is mounted in the body 100. The protruding pressure rod 103 may be formed on the upper cover 102. The upper cover 102 is moved such that the opening 101 is closed, and thus the pressure rod 103 is moved toward a hole 302 of the toner cartridge 300. A part of the pressure rod 103 is inserted into the hole 302 and contacts the end portion 351 of the lever unit 350. The pressure rod 103 contacts the lever unit 350 and applies a pressure thereto when the opening 101 is closed by the upper cover 102.

Figure 10A:
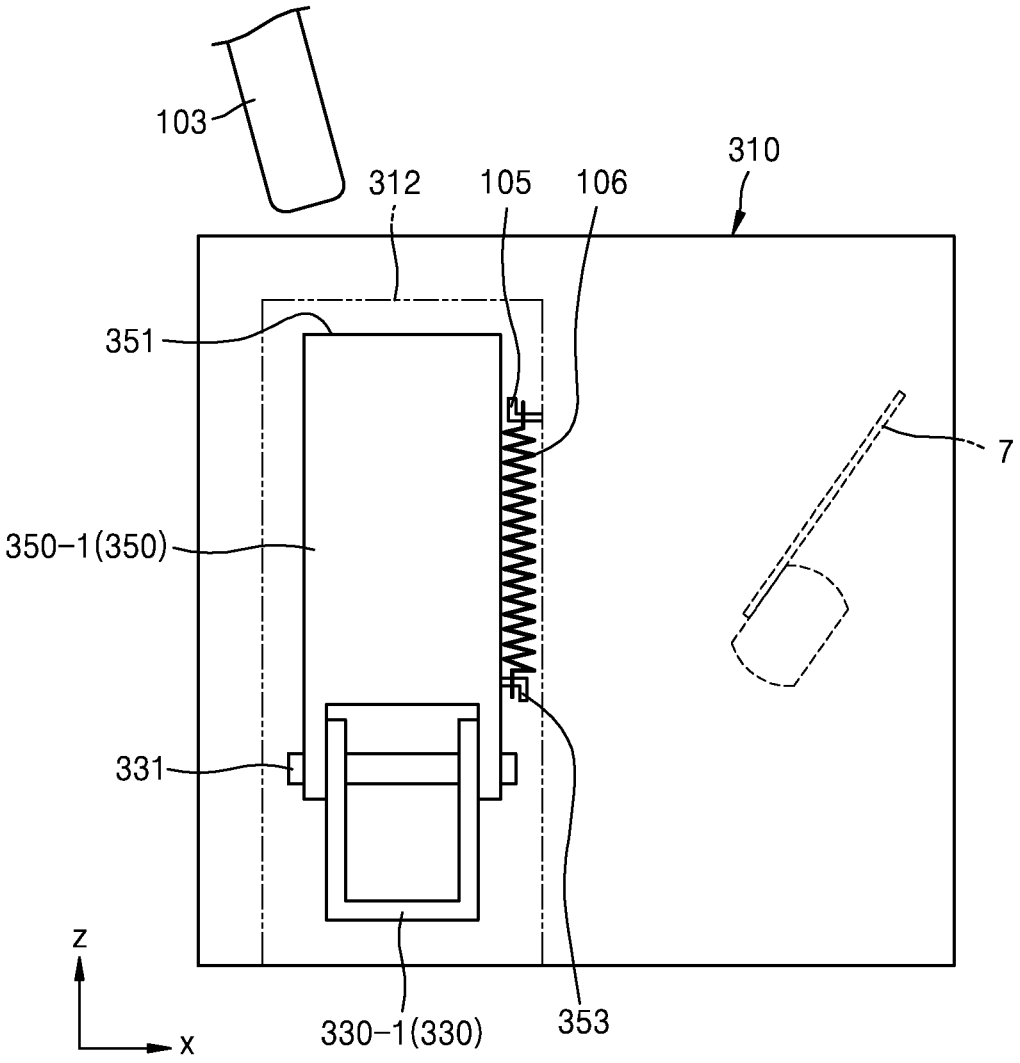
FIGS. 10A and 10B illustrate an exemplary operating state of a lever unit due to an upper cover.
Figure 10B:
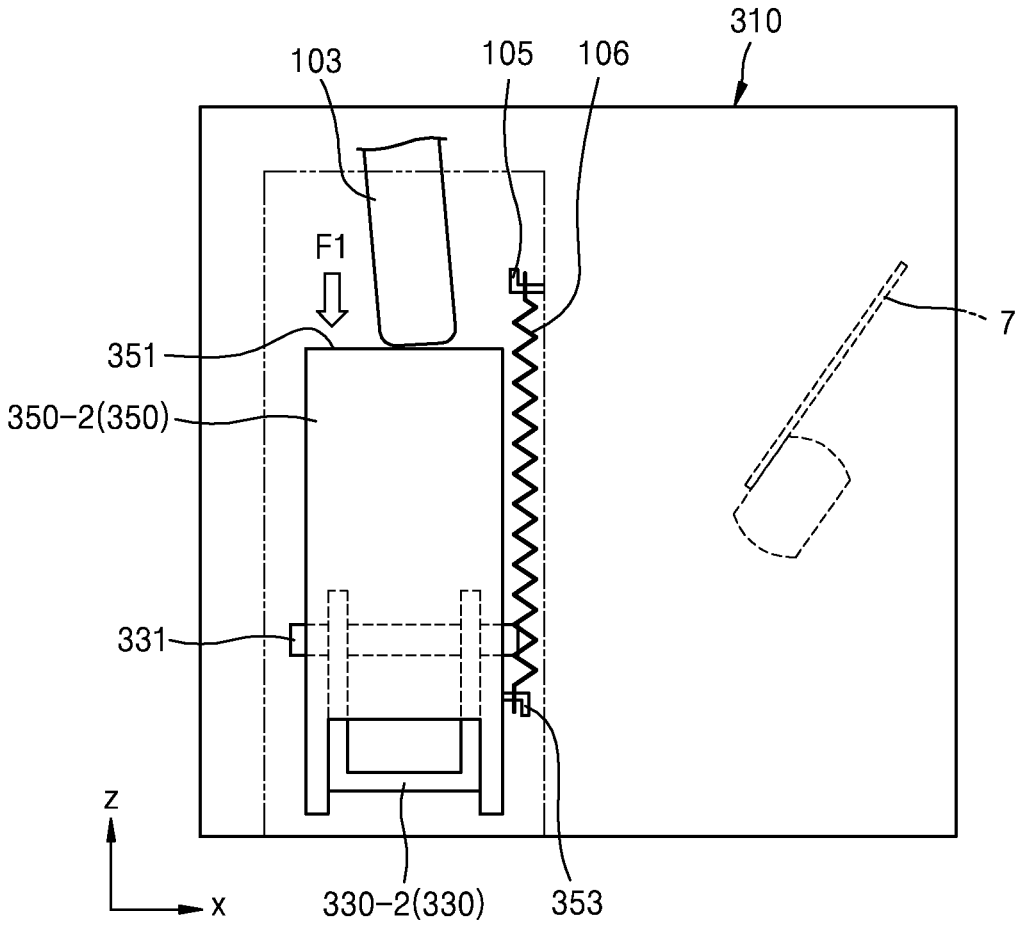

FIGS. 10A and 10B illustrate an operating state of the lever unit 350 due to the upper cover 102. Referring to FIG. 10A, before the pressure rod 103 contacts the lever unit 350, the lever unit 350 is disposed in the reference position 350-1. If a user closes the upper cover 102, the pressure rod 103 contacts the end portion 351 of the lever unit 350 and applies pressure to the lever unit 350 as illustrated in FIG. 10B. Accordingly, the external force F1 is applied to the lever unit 350. The lever unit 350 moves from the reference position 350-1 to the pressure position 350-2 in the second direction (z axis) due to the external force F1. When the lever unit 350 moves from the reference position 350-1 to the pressure position 350-2, the shutter unit 330 connected to the lever unit 350 moves from the closing position 330-1 (see, for example, FIG. 6A) to the opening position 330-2 (see, for example, FIG. 6B).

When the user opens the upper cover 102, contact of the pressure rod 103 and the lever unit 350 may be released. Accordingly, the external force F1 applied to the end portion 351 of the lever unit 350 is removed, and the lever unit 350 moves from the pressure position 350-2 to the reference position 350-1 due to the elastic member 106. The shutter unit 330 moves from the opening position 330-2 to the closing position 330-1. The shutter unit 330, when in the closing position 330-1, prevents toner from being discharged from the toner outlet 301.

As another example of applying external force to the lever unit 350 in a direction that crosses the first direction (y axis), the end portion 351 of the lever unit 350 may be pressured by the body 100 when mounting the toner cartridge 300 coupled to the development cartridge 200 in the body 100. When mounting the toner cartridge 300 in the body 100, external force F2 may be applied to an end portion 351*a* of a lever unit 350*a* in the direction A2 opposite to the direction A1 in which the development cartridge 200 or the toner cartridge 300 is mounted in the body 100.

Figure 11:
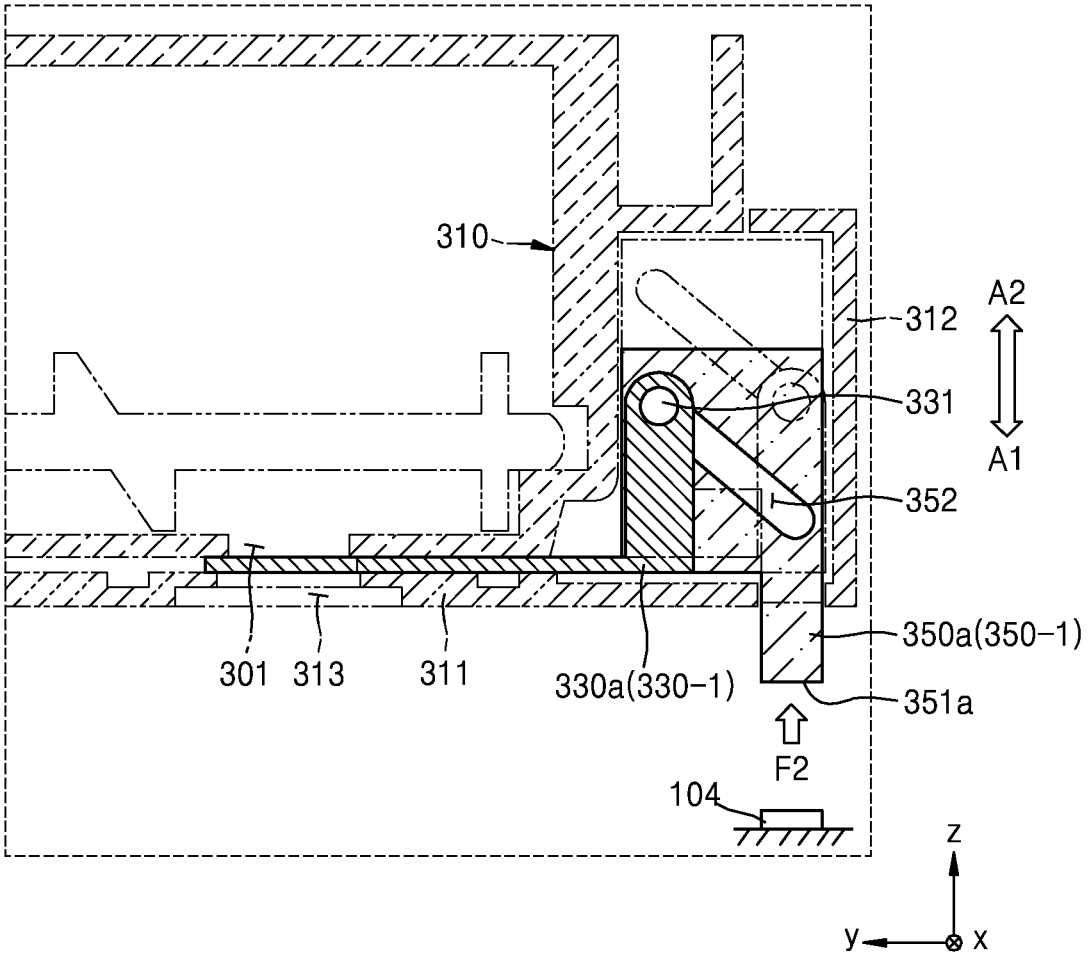
FIG. 11 schematically illustrates an exemplary toner cartridge of FIG. 4.

FIG. 11 schematically illustrates another example of the toner cartridge 300 of FIG. 4. An example of applying the external force F2 to the end portion 351*a* of the lever unit 350*a* in the direction A2 opposite to the direction A1 in which the toner cartridge 300 is mounted in the body 100 is described below with reference to FIG. 11.

The toner cartridge 300 includes the container unit 310, the shutter unit 330*a*, and the lever unit 350*a*. The shutter unit 330*a* and the container unit 310 may be the same as those described with reference to FIG. 8. The lever unit 350*a* may be different from that described with reference to FIG. 8. The same reference numerals denote the same elements between FIGS. 8 and 11, and thus redundant descriptions are not repeated. The end portion 351*a* of the lever unit 350*a* protrudes in the direction A1 in which the toner cartridge 300 is mounted in the body 100. The protruding end portion 351*a* may be exposed to the outside of the toner cartridge 300 as illustrated in FIG. 11. However, an arrangement of the end portion 351*a* of the lever unit 350 is not limited thereto. The end portion 351*a* may not be exposed to the outside of the toner cartridge 300.

The toner cartridge 300 approaches the body 100 in the direction A1 in which the toner cartridge 300 is mounted in the body 100. An interference member 104 may be formed in the body 100 and may restrict a movement of the lever unit 350*a* of the toner cartridge 300 when mounting the toner cartridge 300 in the body 100. The interference member 104 may protrude in the direction A2 in which the toner cartridge 300 is removed from the body 100. The lever unit 350*a* may be disposed in the reference position 350-1, and the shutter unit 330*a* is disposed in the closing position 330-1 before contacting the interference member 104 of the body 100. In this regard, when the toner cartridge 300 approaches the body 100 in the direction A1 in which the toner cartridge 300 is mounted in the body 100, the end portion 351*a* of the lever unit 350*a* contacts the interference member 104. The lever unit 350*a* moves in the direction A2 opposite to the direction A1 in which the toner cartridge 300 is mounted in the body 100 due to the interference member 104 and is disposed in the pressure position 350-2. While the lever unit 350*a* moves from the reference position 350-1 to the pressure position 350-2, the movement pin 331 inserted into the movement guide 352 moves right in the first direction (y axis). Accordingly, the shutter unit 330*a* moves right in the first direction (y axis) and is disposed in the opening position 330-2.

As an example of applying the external forces F1 and F2 to the lever unit 350, the process of closing the upper cover 102 or the process of mounting the toner cartridge 300 is described but is not necessarily limited thereto. The user may apply pressure to the lever unit 350 by directly applying pressure to the lever unit 350.

The shutter unit 330 and the lever unit 350 may be connected to each other by the movement pin 331 and the movement guide 352 in the toner cartridge 300. However, a connection structure between the shutter unit 330 and the lever unit 350 is not limited thereto, and may be modified in various ways.

Figure 12:
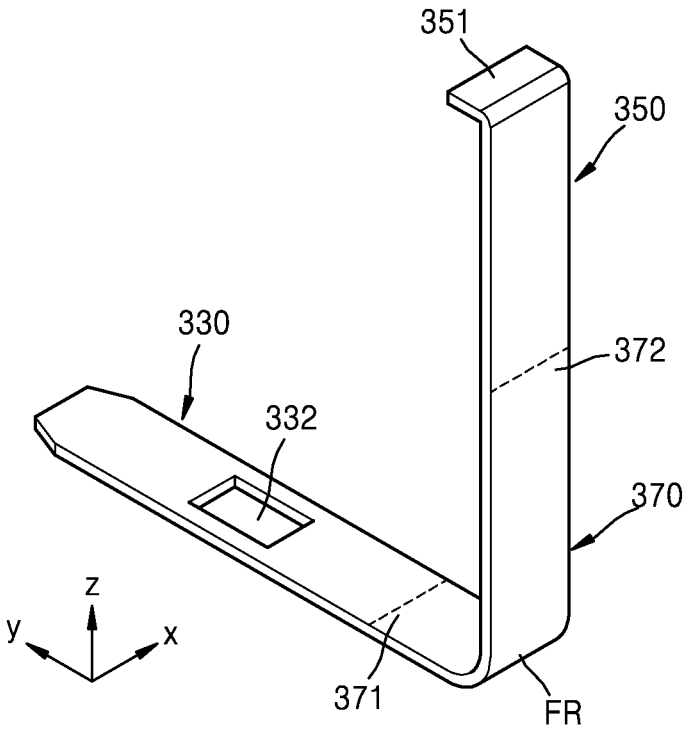
FIG. 12 is a schematic perspective view of a bendable member disposed between a shutter unit and a lever unit.

As another example of the connection structure of the shutter unit 330 and the lever unit 350, a bendable bendable member 370 illustrated in FIG. 12 may be disposed between the shutter unit 330 and the lever unit 350.

FIG. 12 is a schematic perspective view of the bendable member 370 disposed between the shutter unit 330 and the lever unit 350. Referring to FIG. 12, one end 371 of the bendable member 370 may be connected to the shutter unit 330, and another end 372 thereof is connected to the lever unit 350. The bendable member 370 may be bent from the first direction (y axis) toward the second direction (z axis). At least a partial region FR of the bendable member 370 is bent, and thus the bendable member 370 connects the shutter unit 330 disposed in the first direction (y axis) and the lever unit 350 disposed in the second direction (z axis). Although the bendable member 370 is divided into the shutter unit 330 and the lever unit 350 according to dotted lines for convenience of description, the bendable member 370 may be separate from the shutter unit 330 and the lever unit 350 or may be integrally formed with at least one of the shutter unit 330 and the lever unit 350.

The bendable member 370 may be bent according to a characteristic of a material or a structure which forms the bendable member 370. For example, the bendable member 370 may be formed of an elastic material, may be a thin plate having a predetermined thickness or less, or may have a structure in which a plurality of grooves are arranged in a length direction.

Figure 13A:
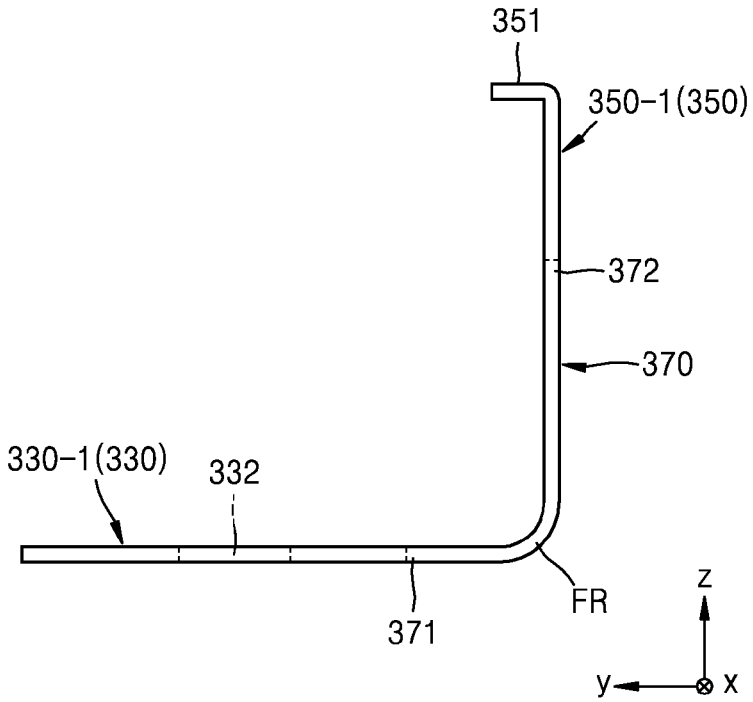
FIGS. 13A and 13B illustrate an exemplary operating state of a bendable member when external force is applied to the lever unit of FIG. 12.
Figure 13B:
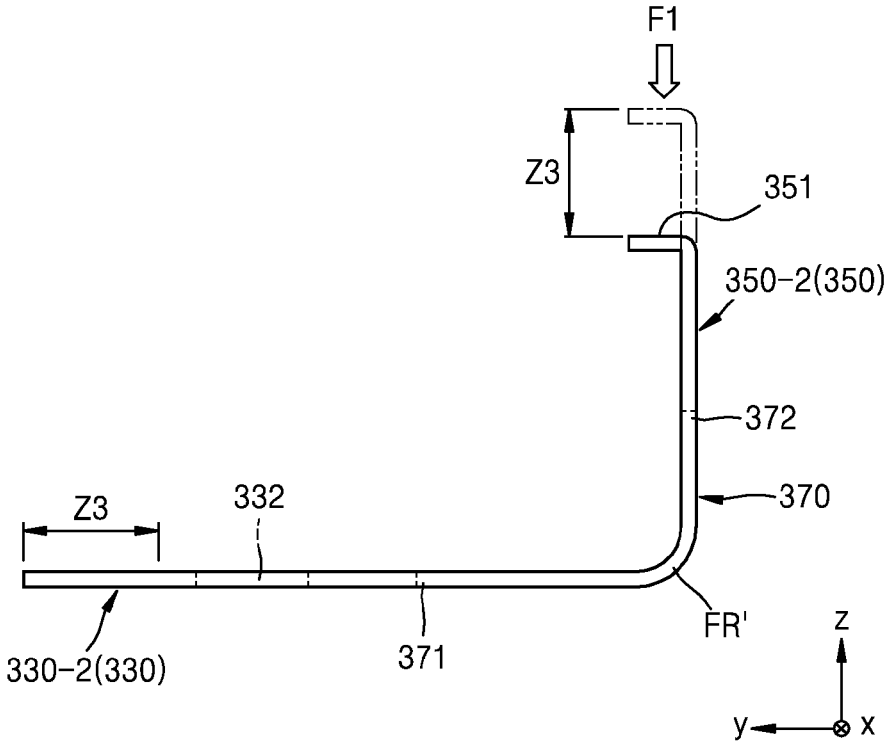

FIGS. 13A and 13B illustrate an operating state of the bendable member 370 when the external force F1 is applied to the lever unit 350 of FIG. 12. FIG. 13A illustrates the operating state of the bendable member 370 before the external force F1 is applied to the end portion 351 of the lever unit 350. FIG. 13B illustrates the operating state of the bendable member 370 after the external force F1 is applied to the end portion 351 of the lever unit 350.

Referring to FIGS. 13A and 13B, when the external force F1 is applied to the end portion 351 of the lever unit 350, the lever unit 350 moves in the second direction (z axis) from the reference position 350-1 to the pressure position 350-2. The shutter unit 330 is connected to the lever unit 350 via the bendable member 370, and thus, when the lever unit 350 moves in the second direction (z axis) by a movement distance Z3, the shutter unit 330 moves in the first direction (y axis) by the movement distance Z3. Accordingly, the shutter unit 330 moves in the first direction (y axis) from the closing position 330-1 to the opening position 330-2. While the lever unit 350 moves between positions, a relative position of the bent region FR of the bendable member 370 varies with respect to the shutter unit 330 and the lever unit 350. For example, a distance between the lever unit 350 and the bent region FR in the reference position 350-1 and a distance between the lever unit 350 and the bent region FR in the pressure position 350-2 may vary.

Figure 14A:
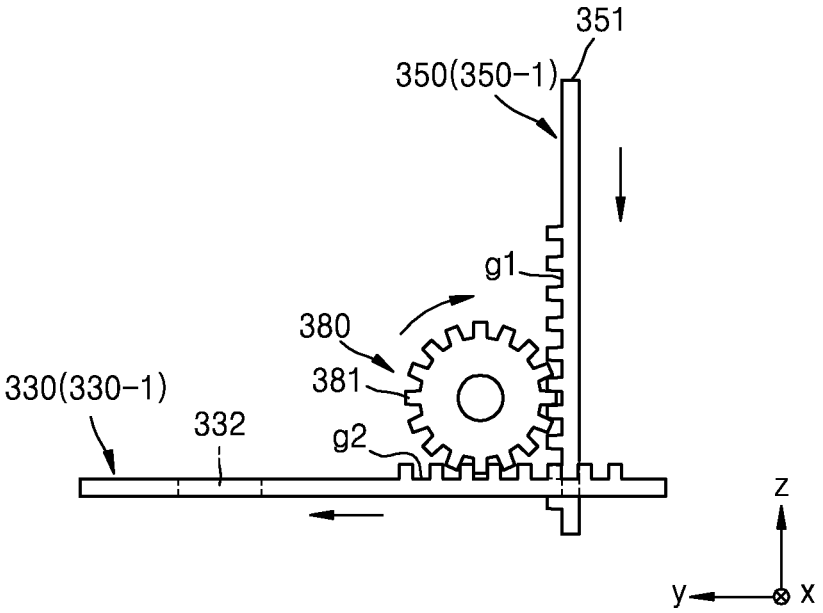
FIG. 14A schematically illustrates a shutter unit and a lever unit that are connected to each other by a rotation member.
Figure 14B:
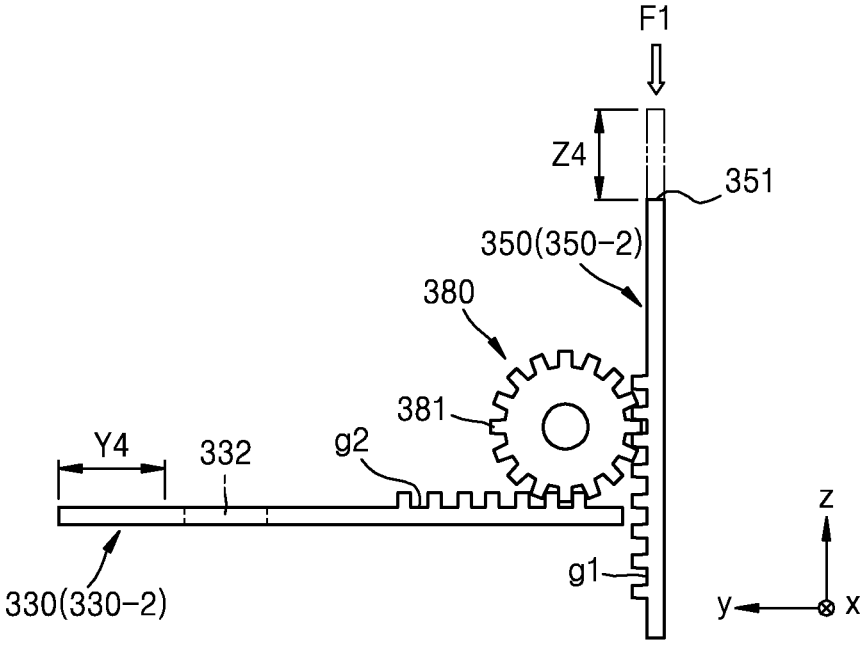
FIG. 14B illustrates an operating state of a lever unit, the rotation member, and a shutter unit after external force is applied to an end portion of the lever unit of FIG. 14A.

As another example of a connection structure of the shutter unit 330 and the lever unit 350, a rotation member 380 illustrated in FIGS. 14A and 14B that contacts the shutter unit 330 and the lever unit 350 may be further provided.

FIG. 14A schematically illustrates the shutter unit 330 and the lever unit 350 that are connected to each other by the rotation member 380. Referring to FIG. 14A, the rotation member 380 contacts the shutter unit 330 and the lever unit 350, converts force that is applied to the lever unit 350 in the second direction (z axis) into force that is applied to the lever unit 350 in the first direction (y axis) perpendicular to the second direction (z axis), and transfers the force to the shutter unit 330. As an example, a groove g1 corresponding to a protrusion 381 formed on an outer circumference surface of the rotation member 380 may be formed in the lever unit 350, and a groove g2 corresponding to a protrusion 382 formed on the outer circumference surface of the rotation member 380 may be formed in the shutter unit 330.

FIG. 14B illustrates an operating state of the lever unit 350, the rotation member 381, and the shutter unit 330 after the external force F1 is applied to the end portion 351 of the lever unit 350 of FIG. 14A. Referring to FIG. 14B, when the external force F1 is applied, the lever unit 350 moves from the reference position 350-1 to the pressure position 350-2 in the second direction (z axis) by a predetermined distance Z4. The rotation member 380 that contacts the lever unit 350 rotates in a clockwise direction due to the movement of the lever unit 350. The shutter unit 330 that contacts the rotation member 380 moves left in the first direction (y axis). Accordingly, the shutter unit 330 moves from the closing position 330-1 to the opening position 330-2 due to the movement of the lever unit 350 by the predetermined distance Z4. The movement distance Z4 of the lever unit 350 may be the same as a movement distance Y4 of the shutter unit 330.

If the external force F1 applied to the end portion 351 of the lever unit 350 is removed, the lever unit 350 rises in the second direction (z axis) and moves from the pressure position 350-2 to the reference position 350-1. The rotation member 380 that contacts the lever unit 350 rotates in a counterclockwise direction due to the movement of the lever unit 350. The shutter unit 330 that contacts the rotation member 380 moves right in the first direction (y axis). Accordingly, the shutter unit 330 moves from the opening position 330-2 to the closing position 330-1.

Although a single rotation member 380 may be provided in an embodiment, the present invention is not limited thereto. A plurality of the rotation members 380 may be provided. The movement distance Z4 of the lever unit 350 and the movement distance Y4 of the shutter unit 330 may be differently set according to the gear ratios of the plurality of rotation members 380 that contact the shutter unit 330 and the lever unit 350.

In the above-described embodiment, a method of mounting the toner cartridge 300 in the body 100 after mounting the toner cartridge 300 in the development cartridge 200, i.e., an indirect mounting method, is explained. However, the method of mounting the toner cartridge 300 in the body 100 is not limited thereto. The toner cartridge 300 may be directly mounted in the body 100.

Although, as an example of the development cartridge 200, a process cartridge in which a photoconductive unit including the photoconductive drum 1 and a development unit including the development roller 4 are integrally formed is explained in the above-described embodiment, the scope of the present invention is not limited thereto. For example, the development cartridge 200 according to the present invention may be applied to a structure in which the photoconductive unit and the development unit are separate from each other.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A cartridge unit to discharge toner via a toner outlet, the cartridge unit comprising:

a shutter including a surface with an opening, the shutter movable in a first direction between an opening position in which at least a part of the opening overlaps at least a part of the toner outlet and a closing position in which the toner outlet is covered by a part of the surface of the shutter not including an opening; and a lever linearly movable in a second direction that crosses the first direction, and connected to the shutter such that the shutter moves in the first direction if the lever linearly moves in the second direction, wherein the second direction is perpendicular to the first direction.

2. The cartridge unit of claim 1, wherein, if external force is applied to the lever, the lever linearly moves in the second direction from a reference position that is a position before the external force is applied to the lever to a pressure position that is a position after the external force is applied to the lever.

3. The cartridge unit of claim 2, wherein, if the lever linearly moves from the reference position to the pressure position, the shutter moves from a closing position to an opening position.

4. The cartridge unit of claim 2, wherein a movement distance from the reference position to the pressure position is different from a movement distance between the closing position and the opening position.

5. The cartridge unit of claim 2, wherein a movement distance from the reference position to the pressure position is the same as a movement distance between the closing position and the opening position.

6. The cartridge unit of claim 1, wherein one of the shutter and the lever comprises a movement pin, and the other comprises a movement guide formed extending in a direction which crosses the first direction such that the movement guide guides movement of the movement pin.

7. The cartridge unit of claim 1, further comprising: a bendable member bendable from the first direction toward the second direction between the shutter and the lever.

8. The cartridge unit of claim 1, further comprising: a rotation member that is rotatable and contacting the shutter and the lever.

9. The cartridge unit of claim 1, wherein the second direction crosses a plane on which the toner outlet is formed.

10. The cartridge unit of claim 1, wherein the shutter is linearly movable in the first direction between the opening position and the closing position.

11. The cartridge unit of claim 1, wherein an end portion of the lever is adapted to receive an external force so as to move the lever in the second direction, the end portion being disposed so as not to protrude outside the cartridge unit.

12. An electrophotographic image forming apparatus comprising:

a body comprising a body opening and a cover which opens and closes the body opening; and a cartridge unit discharging toner via a toner outlet and detachably mounted in the body via the body opening, wherein the cartridge unit comprises:

a shutter including a surface with an opening, the shutter movable in a first direction between an opening position in which at least a part of the opening overlaps at least a part of the toner outlet, and a closing position in which the toner outlet is covered by a part of the surface of the shutter not including an opening, and a lever linearly movable in a second direction which crosses the first direction, and connected to the shutter such that the shutter moves in the first direction if the lever linearly moves in the second direction, wherein the second direction is perpendicular to the first direction.

13. The electrophotographic image forming apparatus of claim 12, wherein, if external force is applied to the lever, the lever linearly moves in the second direction from a reference position that is a position before the external force is applied to the lever to a pressure position that is a position after the external force is applied to the lever.

14. The electrophotographic image forming apparatus of claim 13, wherein, if the lever moves from the reference position to the pressure position, the shutter linearly moves from the closing position to the opening position.

15. The electrophotographic image forming apparatus of claim 13, wherein a movement distance from the reference position to the pressure position is different from a movement distance between the closing position and the opening position.

16. The electrophotographic image forming apparatus of claim 12, wherein the second direction crosses a plane on which the toner outlet is formed.

17. The electrophotographic image forming apparatus of claim 12, wherein the cover comprises a pressure rod which applies pressure to a lever and moves a shutter from a closing position to an opening position when closing the opening.

18. The electrophotographic image forming apparatus of claim 12, wherein the body comprises an interference member which applies pressure to a lever and moves a shutter from a closing position to an opening position when mounting the cartridge unit.

19. The electrophotographic image forming apparatus of claim 12, wherein the shutter is linearly movable in the first direction between the opening position and the closing position.

* * * * *